United States Patent [19]

Kuna

[11] Patent Number: 4,571,211

[45] Date of Patent: Feb. 18, 1986

[54] TOY PULL ACCESSORY FOR SELF-PROPELLED TOY VEHICLE

[75] Inventor: Wayne A. Kuna, Oak Park, Ill.

[73] Assignee: Marvin Glass & Associates, Chicago, Ill.

[21] Appl. No.: 578,195

[22] Filed: Feb. 8, 1984

[51] Int. Cl.[4] ..... A63H 17/26

[52] U.S. Cl. ..... 446/448; 446/434; 446/466; 74/112

[58] Field of Search ..... 446/427, 428, 434, 441, 446/448, 449, 465, 466; 198/741; 73/862.03; 74/112, 116, 128

[56] References Cited

U.S. PATENT DOCUMENTS

| | | | |
|---|---|---|---|
| 3,205,616 | 9/1965 | Nisperly | 446/466 |
| 3,578,412 | 5/1971 | Martin | 198/741 |
| 3,655,020 | 4/1972 | Van Slooten | 74/116 |
| 3,659,455 | 5/1972 | Watkins | 73/862.03 |
| 4,389,810 | 6/1983 | Green | 73/862.03 |
| 4,475,304 | 10/1984 | Goldfarb et al. | 446/465 |

FOREIGN PATENT DOCUMENTS

| | | | |
|---|---|---|---|
| 2345963 | 4/1974 | Fed. Rep. of Germany | 198/741 |

*Primary Examiner*—Robert A. Hafer
*Assistant Examiner*—Daniel Nolan
*Attorney, Agent, or Firm*—John S. Pacocha

[57] ABSTRACT

A toy pull-sled accessory for a self-propelled toy vehicle is supported for towing on a play surface by a forward friction pad and freely rotatable rear wheels. Friction with the surface is increased by a weight with a pivotally depending pawl movable along a ratchet rack from over the rear wheels toward and over the forward friction pad. Mounted for rotation on a rear wheel axle is a gear which periodically shuttles the rack forward against a rearward return bias to advance the weight.

16 Claims, 4 Drawing Figures

TOY PULL ACCESSORY FOR SELF-PROPELLED TOY VEHICLE

BACKGROUND OF THE INVENTION

1. Field of the Invention

This invention relates generally to toy vehicle accessories and more particularly to a weight pull-sled accessory for a self-propelled toy vehicle.

2. Background Art

Weight pulling contests between tractors, trucks and specialized vehicles such as the "BIG FOOT" 4×4×4 are polular entertainment events. U.S. Pat. No. 3,491,590 disclosed a pull-sled or weight transfer apparatus which provides a solution to problems presented by prior methods of increasing the weight being pulled in real life pulling contests. A prior toy pull-sled which relies on a string passing over a set of pulleys and winding around a rear axle to move a weight up an inclined ramp from over the rear wheels toward a forward friction pad is disclosed in U.S. Pat. No. 4,389,810. There remains, however, a need for a toy pull-sled accessory which uses a positive engagement transfer mechanism for moving the weight from the rear wheels toward the friction pad and avoids the problems, such as tangling, involved in the use of a string.

SUMMARY OF THE INVENTION

The present invention is concerned with providing a toy pull-sled accessory for a self-propelled vehicle in which a weight is moved by an elongated gear from over rear rotatable play surface engaging wheels toward a forward friction pad to increase resistance as the sled is pulled forward. These and other objects and advantages of the invention are achieved by supporting a ratchet rack for reciprocal movement under rails forming a frame on which the weight moves, biasing the rack toward the rear of the frame and providing a gear mounted for rotation on one of the rear axles for periodic engagement with the rack. A pawl pivotally depending from the weight engages the ratchet teeth and moves the weight forward as the rack is shuttled back and forth by the rotating gear and bias. After a run with the toy pull-sled accessory is completed, the weight is returned to a starting position by simply lifting it off of the frame and replacing it on the frame adjacent the rear end.

BRIEF DESCRIPTION OF THE DRAWING

For a better understanding of the present invention reference may be had to the accompanying drawing in which.

DETAILED DESCRIPTION OF THE PREFERRED EMBODIMENT

Figures 1, 2, 3, 4:
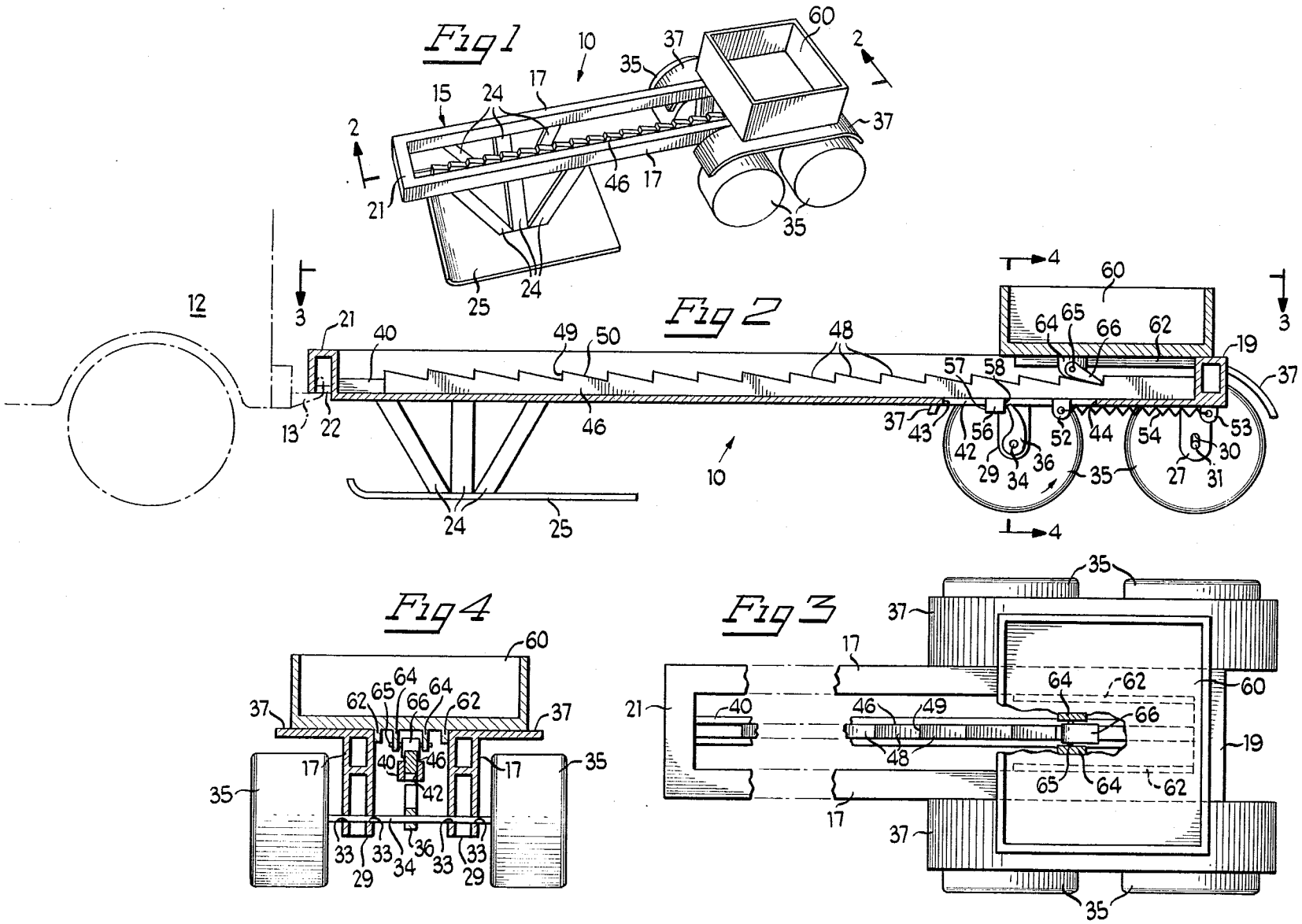
FIG. 1 is a perspective view of an embodiment of the present invention.
FIG. 2 is an enlarged scale, sectional view taken generally along the line 2—2 of FIG. 1 and showing a toy vehicle in phantom.
FIG. 3 is a fragmented, top plan view generally along the line 3—3 of FIG. 2.
FIG. 4 is a sectional view taken generally along the line 4—4 of FIG. 2.

Referring now to the drawing in which like parts are designated by like reference numerals throughout the several views, there is shown in FIG. 1 a toy weight pull-sled accessory 10 generally intended for use with a self-propelled toy vehicle. In FIG. 2, a vehicle 12, preferably a self-propelled vehicle, is shown in phantom. The vehicle has a hitch or hook 13 for attaching the pull-sled 10 for towing.

Pull-sled accessory 10 has an elongated frame 15 with a generally rectangular upper portion formed of side rails 17, rear cross-beam 19 and front cross-beam 21. The rails and cross-beams are conveniently formed of a hollow rectangular cross section to provide adequate strength and light weight. Approximately in the center of the underside of the front cross-beam 21 is an opening 22 for receiving the hitch or hook 13 of the towing vehicle. Depending downwardly from each rail adjacent the forward end of the frame 15 is a set of struts 24 which support a relatively large, flat, surface engaging friction pad 25.

Toward the rear of the frame are spaced apart axle supports 27 and 29 also depending downwardly from each of the side rails 17. The rearmost axle supports 27 each have an aligned, vertically extended slot 30 receiving a rearmost axle 31. Inwardly spaced axle supports 29 only have a circular aperture 33 receiving an axle 34 for rotation. Both the rearmost axle 31 and the inner axle 34 are of the same diameter. On a level horizontal surface the bottom of the extended slot 30 is substantially aligned with the bottom of aperture 33 but the slot 30 extends above the aperture 33 by about twice the diameter of the axle 31. Attached at the end of each of the axles 31 and 34 for free-wheeling rotation with the axles is a wheel 35. A single tooth gear 36 is also mounted on the axle 34 for rotation with the axle.

Over the tandem set of axles 31 and 34 lateral extensions 37 of the side rails 17 form fenders which are disposed no higher than the tops of the rails 17. Substantially centrally disposed between the side rails 17 and below the level of the top of the rails is an elongated, flat bottom "U" shaped channel 40 extending from the rear cross-beam 19 to the front cross-beam 21. In the bottom of the channel 40, over the inner axle 34 and extending forward and rearward of the axle 34 a distance approximately the diameter of the wheel 35, is a slot 42 having a forward edge 43 and a rearward edge 44.

An elongated ratchet rack 46 is seated in the channel 40 for reciprocal movement between the back and front of the frame 15. Rack 46 has a plurality of ratchet teeth 48 which, as the rack is seated in the channel 40, face upwardly. The rack is shorter than the distance between the rear cross-beam 19 and the front cross-beam 21 by approximately the length of one of the ratchet teeth. Each of the teeth 48 is of the same length and has a short, sharp, essentially vertical, slope 49 on one side and a longer, more gradual, slope 50 from a high forward point to a low rearward point on the other side. A tab 52 is attached to the bottom of the rack 46 adjacent the rear end and projects through the slot 42. Beneath approximately the center of the rear cross-beam 19 there is a similar tab 53. Spring 54, or an elastic member, is extended in tension between the tabs 52 and 53 to bias the back end of the rack 46 against the rear cross-beam 19.

Projecting down from the rack 46, forward of the tab 52 and also disposed within the slot 42, is a finger or tooth 56 having a forward edge 57 and a rearward edge 58. With the back end of the rack 46 abutting the rear cross-beam 19, the distance between the forward edge 57 and the forward edge 43 of the slot is, again, about equal to the length of one of the ratchet teeth 48. During every revolution of the wheels mounted on axle 34 in a counterclockwise direction as shown in FIG. 2, the single tooth gear 36 will engage the rearward edge 58 of the finger or tooth 56 and push it, together with the rack 46, forward against the bias of the spring 54. The amount of forward movement of the rack 46 is limited by abutment of the front of the rack against the front cross-beam 21 as well as abutment of the forward edge 57 of the tooth 56 and the front edge 43 of the slot 42.

Weight box 60 is a generally rectangular open topped container. Although shown as empty, it will be appreciated that additional weight in the form of various items (not shown) may be added to the hollow container to increase the weight. Depending below the bottom of the weight box 60 is a pair of elongated, spaced apart, flanges 62 which position the weight box laterally within the rails 17 as is best illustrated in FIGS. 3 and 4. Between the flanges 62, more closely spaced trunnions 64 project down from the bottom of the box 60. Pivotally mounted on pin 65 extending through the trunnions is a pawl 66. Gravity biases the pawl 66 downwardly into engagement with the ratchet teeth 48 of the rack 46 as is best shown in FIG. 2. To position the weight box for starting, the box is placed atop the rails 17 with the flanges 62 abutting cross-beam 19 so that pawl 66 drops into the first or rearmost tooth 48. When the rack 46 is pushed forward by the tooth 36, the weight box 60 is advanced the length of one tooth 48 by the engagement between the pawl 66 and the sharply sloping side 49 of the tooth.

As the vehicle 12 pulls the accessory 10 forward, the drive tooth 36 will periodically engage the depending tooth 56 and together with the bias of the spring 54 will shuttle the rack 46 back and forth advancing the weight box 60. Forward movement of the weight increases the friction between the pad 25 and the playing surface until eventually the power of the towing vehicle 12 is no longer sufficient to drag the pull-sled. The mechanical engagements also generate a sound which enhances the enjoyment of the toy. Once such a run is completed the weight box 60 is merely lifted off of the frame 15 and replaced adjacent the rearward end of the frame in its starting position. If the play surface under the rearmost wheels on axle 31 is slightly higher than that under the inner wheels on axle 34, the inner wheels would not contact the surface and hence not drive the single toothed gear 36. Maintaining this necessary contact even on a slightly irregular play surface is insured by the mounting of the rearmost axle 31 within the vertically extended slot 30.

A second gear (not shown) having two or more teeth could be mounted on the axle 34 adjacent the gear 36 such that the gears would be selectively engagable with the projecting tooth 56 in order to provide a faster rate of forward movement of the weight 60 along the pull-sled. While a particular embodiment of the present invention has been shown and described, it will be apparent that various changes and modifications will occur to those skilled in the art. It is intended to cover all such changes and modifications in the following claims as fall within the true spirit and scope of the present invention.

What is claimed as new and desired to be secured by Letters Patent is:

1. A toy pull-sled accessory for a self-propelled toy vehicle comprising:

an elongated frame having a rear end and a front end;

a weight supported for movement along the elongated frame;

a pair of surface engaging wheels mounted on an axle for rotation with the axle;

means connecting the axle to the frame adjacent the rear end for rotation relative to the frame;

a friction pad depending from adjacent the front end of the frame and adapted to engage the same surface as the wheels;

an elongated gear extending beneath the weight intermediate the ends of the frame;

means on the weight engaging the elongated gear;

a drive gear mounted on the axle for rotation with the axle and in at least periodic engagement with the elongated gear to drive the elongated gear; and linear movement of the weight along the frame from adjacent the rear end to adjacent the front end of the frame being effected solely by the engagement between the means on the weight and the driven elongated gear.

2. The toy pull-sled of claim 1 in which the means on the weight releasably engages the elongated gear.

3. The toy pull-sled of claim 1 in which the elongated gear is a rack.

4. The toy pull-sled of claim 3 in which the rack has ratchet teeth facing the weight and the means on the weight engaging the ratchet teeth is a pawl.

5. The toy pull-sled of claim 4 in which the pawl is pivotally connected to the weight and is biased toward engagement with the rack.

6. The toy pull-sled of claim 5 in which the pawl is biased by gravity.

7. The toy pull-sled of claim 1 including:

a second axle in addition to the axle on which the drive gear is mounted for rotation;

the second axle being connected to the frame for rotation relative to the frame; and surface engaging wheels mounted on the second axle for rotation with the second axle.

8. The toy pull-sled of claim 7 in which the second axle is rearward of the axle on which the drive gear is mounted.

9. The toy pull-sled of claim 7 in which the second axle is connected to the frame for vertical movement relative to the frame.

10. A toy pull-sled accessory for a self-propelled toy vehicle comprising:

an elongated frame having a rear end and a front end;

a weight supported for movement along the elongated frame;

a pair of surface engaging wheels mounted on an axle for rotation with the axle;

means connecting the axle to the frame adjacent the rear end for rotation relative to the frame;

a friction pad depending from adjacent the front end of the frame and adapted to engage the same surface as the wheels;

a rack extending beneath the weight intermediate the ends of the frame;

the rack being biased toward the rear of the frame;

means on the weight engaging the rack; and a drive gear mounted on the axle for rotation with the axle and in at least periodic engagement with the rack to transmit rotation of the axle into linear movement of the weight along the frame from adjacent the rear end to adjacent the front end of the frame.

11. The toy pull-sled of claim 10 in which a spring extending between the rack and the frame biases the rack.

12. The toy pull-sled of claim 10 in which the drive gear mounted on the axle has a single tooth which periodically engages the rack to push the rack forward against the bias.

13. The toy pull-sled of claim 12 including means arresting the forward movement of the rack.

14. The toy pull-sled of claim 13 in which:

the arresting means includes a projection on the rack extending through an elongated slot in the frame;

the slot has a forward end; and the projection is engaged by the drive gear tooth and arresting forward movement of the rack upon abutting the forward end of the slot.

15. The toy pull-sled of claim 13 in which:

the rack is spaced from the front end of the frame by the bias; and forward movement of the rack is arrested by abutment of the rack with the front end of the frame.

16. The toy pull-sled of claim 11 including a second drive gear with more than one tooth mounted on the axle for rotation with the axle and for substitute engagement with the rack in place of the drive gear with the single tooth.

* * * * *